US007852190B1

(12) United States Patent
Woychik et al.

(10) Patent No.: US 7,852,190 B1
(45) Date of Patent: Dec. 14, 2010

(54) SHAPE MEMORY ALLOY (SMA) ACTUATION MECHANISM FOR ELECTRICAL SWITCHING DEVICE

(75) Inventors: Gerard A. Woychik, Shellsburg, IA (US); Ryan J. Legge, Cedar Rapids, IA (US); Matthew W. Jenski, Roselle, IL (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 866 days.

(21) Appl. No.: 11/787,573

(22) Filed: Apr. 17, 2007

(51) Int. Cl.

| | |
|---|---|
| ***H01H 71/18*** | (2006.01) |
| ***H01H 37/46*** | (2006.01) |
| ***H01H 37/50*** | (2006.01) |
| ***H01H 37/04*** | (2006.01) |
| ***F01B 29/10*** | (2006.01) |

(52) U.S. Cl. ..... 337/382; 337/398; 337/123; 337/140; 337/395; 60/528

(58) Field of Classification Search ..... 337/123, 337/140, 382, 395, 398; 60/528
See application file for complete search history.

(56) References Cited

U.S. PATENT DOCUMENTS

| | | | | | |
|---|---|---|---|---|---|
| 3,634,803 | A | * | 1/1972 | Willson et al. | 337/123 |
| 3,846,679 | A | * | 11/1974 | Jost et al. | 361/165 |
| 3,893,055 | A | * | 7/1975 | Jost et al. | 337/140 |
| 3,968,380 | A | * | 7/1976 | Jost et al. | 307/99 |
| 4,007,404 | A | * | 2/1977 | Jost et al. | 361/211 |
| 4,357,589 | A | * | 11/1982 | Payne | 337/315 |
| 4,368,449 | A | * | 1/1983 | Ubukata | 337/313 |
| 4,389,629 | A | * | 6/1983 | Saur et al. | 337/126 |
| 4,479,039 | A | * | 10/1984 | Payne | 200/406 |
| 4,517,543 | A | * | 5/1985 | Brubaker | 337/140 |
| 4,700,541 | A | * | 10/1987 | Gabriel et al. | 60/528 |
| 4,794,364 | A | * | 12/1988 | Uehara | 337/354 |
| 4,839,479 | A | * | 6/1989 | Davis, Jr. | 200/61.45 R |
| 5,083,439 | A | * | 1/1992 | Orner et al. | 62/187 |
| 5,629,662 | A | * | 5/1997 | Floyd et al. | 337/36 |
| 5,684,448 | A | * | 11/1997 | Jacobsen et al. | 337/140 |
| 5,771,742 | A | * | 6/1998 | Bokaie et al. | 74/2 |
| 5,990,777 | A | * | 11/1999 | Whiteman, Jr. | 337/140 |
| 6,016,096 | A | | 1/2000 | Barnes et al. | 337/123 |
| 6,049,267 | A | | 4/2000 | Barnes et al. | 337/123 |
| 6,078,243 | A | | 6/2000 | Barnes et al. | 337/140 |
| 6,133,816 | A | | 10/2000 | Barnes et al. | 337/123 |
| 6,239,686 | B1 | * | 5/2001 | Eder et al. | 337/382 |
| 6,255,934 | B1 | * | 7/2001 | Gadini et al. | 337/393 |

(Continued)

OTHER PUBLICATIONS

U.S. Appl. No. 11/499,104, "Electrical Switching Devices Using a Shape Memory Alloy (SMA) Acutation Mechanism" by inventors Gerard A. Woychik, et al., filed Aug. 4, 2006.

*Primary Examiner*—Jayprakash N Gandhi
*Assistant Examiner*—Bradley H Thomas
(74) *Attorney, Agent, or Firm*—Matthew J. Evans; Daniel M. Barbieri

(57) ABSTRACT

An electrical switching device includes a housing, a base attached to the housing, two non-actuated electrical contacts supported in the housing, and an actuator assembly contained within the housing. The actuator assembly includes a movable contact for engaging the non-actuated electrical contact and a wire element formed of a shape memory alloy. Applying an electric current to the wire element causes the actuator to either pivot or rotate the movable contact to either engage or disengage the non-actuated electrical contacts.

5 Claims, 11 Drawing Sheets

U.S. PATENT DOCUMENTS 6,744,344 B2 * 6/2004 Geuder et al. ..... 337/140
6,843,465 B1 * 1/2005 Scott ..... 251/129.06
6,851,260 B2 * 2/2005 Mernøe ..... 60/527
6,917,276 B1 * 7/2005 Menard et al. ..... 337/140
6,972,659 B2 * 12/2005 von Behrens et al. ..... 337/139
7,256,518 B2 * 8/2007 Gummin et al. ..... 310/12.33
7,628,262 B2 * 12/2009 Barnum et al. ..... 192/58.61
7,652,553 B2 * 1/2010 Neilly et al. ..... 337/384
2004/0003985 A1 * 1/2004 Nishimoto et al. ..... 200/6 A
2005/0151107 A1 * 7/2005 Shu ..... 251/214

* cited by examiner

SHAPE MEMORY ALLOY (SMA) ACTUATION MECHANISM FOR ELECTRICAL SWITCHING DEVICE

RELATED APPLICATIONS

This application is related to U.S. patent application Ser. No. 11/499,104, filed Aug. 4, 2006, entitled "Electrical Switching Devices Using A Shape Memory Alloy (SMA) Actuation Mechanism," with Inventors Gerard A. Woychik, et al, having a common assignee to this application, said related patent application being incorporated by reference herein in its entirety.

FIELD OF THE INVENTION

The present invention relates generally to the field of electrical switching devices, and more particularly to an electrical switching device having an actuator mechanism formed of a shape memory alloy (SMA).

BACKGROUND OF THE INVENTION

Shape memory alloys (SMA), such as nickel-titanium alloys, copper-aluminum-nickel alloys, copper-zinc-aluminum alloys, iron-manganese-silicon alloys, and the like, are metallic alloys that remember their geometry. After such alloys are deformed, they regain their original geometry by themselves during heating (one-way effect) or, at higher ambient temperatures, simply during unloading (pseudo-elasticity). This capability results from a temperature-dependent martensitic phase transformation from a low-symmetry martensite structure to a highly symmetric crystallographic austenite structure. In most shape memory alloys, a temperature change of only about 10° C. is necessary to initiate this phase change. The most common shape memory alloy, a nickel-titanium alloy, was first developed in 1962-1963 by the Naval Ordnance Laboratory, White Oak, Md., and commercialized under the trade name Nitinol (an acronym for Nickel Titanium Naval Ordnance Laboratories).

Electrical switching devices such as relays, switches, and the like, typically employ electromechanical actuators or solenoids which are prone to failure. Complex avionic equipment often employs large numbers of such devices, thereby limiting the reliability of the equipment and aircraft. For example, high frequency (HF) antenna couplers used in aircraft communications systems employ vacuum relays for connecting the capacitors and inductors in the coupler during the tuning phase to create an appropriate impedance match to the antenna. Typical HF Antenna Couplers may employ many such relays (e.g., 30 or more). During manufacture, each relay must be carefully hand soldered and tested. Assemblies of the relays are then functionally tested. The failure of any relay in an assembly may require additional companion relays to be removed and replaced, the assembly to be reassembled, tuned and retested. If a vacuum relay fails in use either before or during flight of the aircraft, the HF antenna coupler must be removed from the aircraft and replaced, which may result in undesirable grounding of the aircraft. Thus, the failure of a single relay is undesirably expensive.

Consequently, it would be advantageous to provide electrical switching devices, including but not limited to, relays, switches, and the like, which employ actuator mechanisms formed of a shape memory alloy (SMA) for improved reliability, reduced number of assembly components, and reduced cost. It is therefore an object of the invention to provide such an electrical switching device.

A feature of the invention is using the contracting and expanding features of a wire made of a shape memory alloy to pivot or rotate a conductive mechanism into contact with a pair of electrical contacts, to thereby complete an electric circuit therebetween.

An advantage of the invention is increased reliability and reduced manufacturing costs when compared to traditional solenoid-based electrical switching device.

SUMMARY OF THE INVENTION

The invention provides an electrical switching device. A housing has first and second non-actuated electrical contacts. A base is connected to the housing and has electrical leads configured to receive a first electric current. An actuator assembly is supported within the housing and the base. The actuator assembly includes a pivotable, substantially non-conductive shaft. A movable contact structure is mounted upon the shaft and configured to be activated by the first electric current between a non-actuated position, where the movable contact structure does not provide a conductive path between the first and second non-actuated electrical contacts, and an actuated position, where the movable contact structure provides a conductive path between the first and second non-actuated electrical contacts so that a second electric current may flow therebetween. The actuator assembly further includes a wire element made from a shape memory alloy (SMA). The wire element is anchored to the base and threaded around a rotatable portion of the shaft. The wire element has a length that is reduced when the first electric current is applied thereto to thereby move the moveable contact structure between one of the non-actuated position and the actuated position and the other of the non-actuated position and the actuated position.

The invention also provides an electrical switching device, including a housing having first and second non-actuated electrical contacts. A base is connected to the housing and has electrical leads configured to receive a first electric current. An actuator assembly is supported within the housing and the base. The actuator assembly includes a rotatable, substantially non-conductive shaft. A movable contact structure is mounted upon the shaft and configured to be activated by the first electric current between a non-actuated position, where the movable contact structure does not provide a conductive path between the first and second non-actuated electrical contacts, and an actuated position, where the movable contact structure provides a conductive path between the first and second non-actuated electrical contacts so that a second electric current may flow therebetween. The actuator assembly further includes a rotatable spindle mounted upon the base and configured to rotate with the shaft. The actuator assembly also includes a wire element made from a shape memory alloy (SMA), the wire element being anchored to the base and threaded upon the spindle. The wire element has a length that is reduced when the first electric current is applied thereto to thereby rotate the spindle, shaft, and the moveable contact structure between one of the non-actuated position and the actuated position and the other of the non-actuated position and the actuated position.

The invention further provides an electrical switching device. A housing has first and second non-actuated electrical contacts. A base is connected to the housing and has electrical leads configured to receive a first electric current. An actuator assembly is supported within the housing and the base. The actuator assembly includes a rotatable, substantially non-conductive shaft. A movable contact structure is mounted upon the shaft and is configured to be activated by the first electric current between a non-actuated position, where the movable contact structure does not provide a conductive path between the first and second non-actuated electrical contacts, and an actuated position, where the movable contact structure provides a conductive path between the first and second non-actuated electrical contacts so that a second electric current may flow therebetween. The moveable contact structure includes a cylindrical drum mounted inside the housing and configured to rotate with the shaft, A conductive strip is applied to an outer surface of the cylindrical drum. The conductive strip has a length at least as long as a distance between the first and second non-actuated electrical contacts. The actuator assembly further includes a rotatable spindle mounted upon the base and configured to rotate with the shaft. A wire element made from a shape memory alloy (SMA). The wire element is anchored to the base and threaded upon the spindle. The wire element has a length that is reduced when the first electric current is applied thereto to thereby rotate the spindle, shaft, and the moveable contact structure between one of the non-actuated position and the actuated position and the other of the non-actuated position and the actuated position. A return mechanism urges the wire to increase in length when the first electric current is no longer applied thereto.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE DRAWINGS

Figure 1:
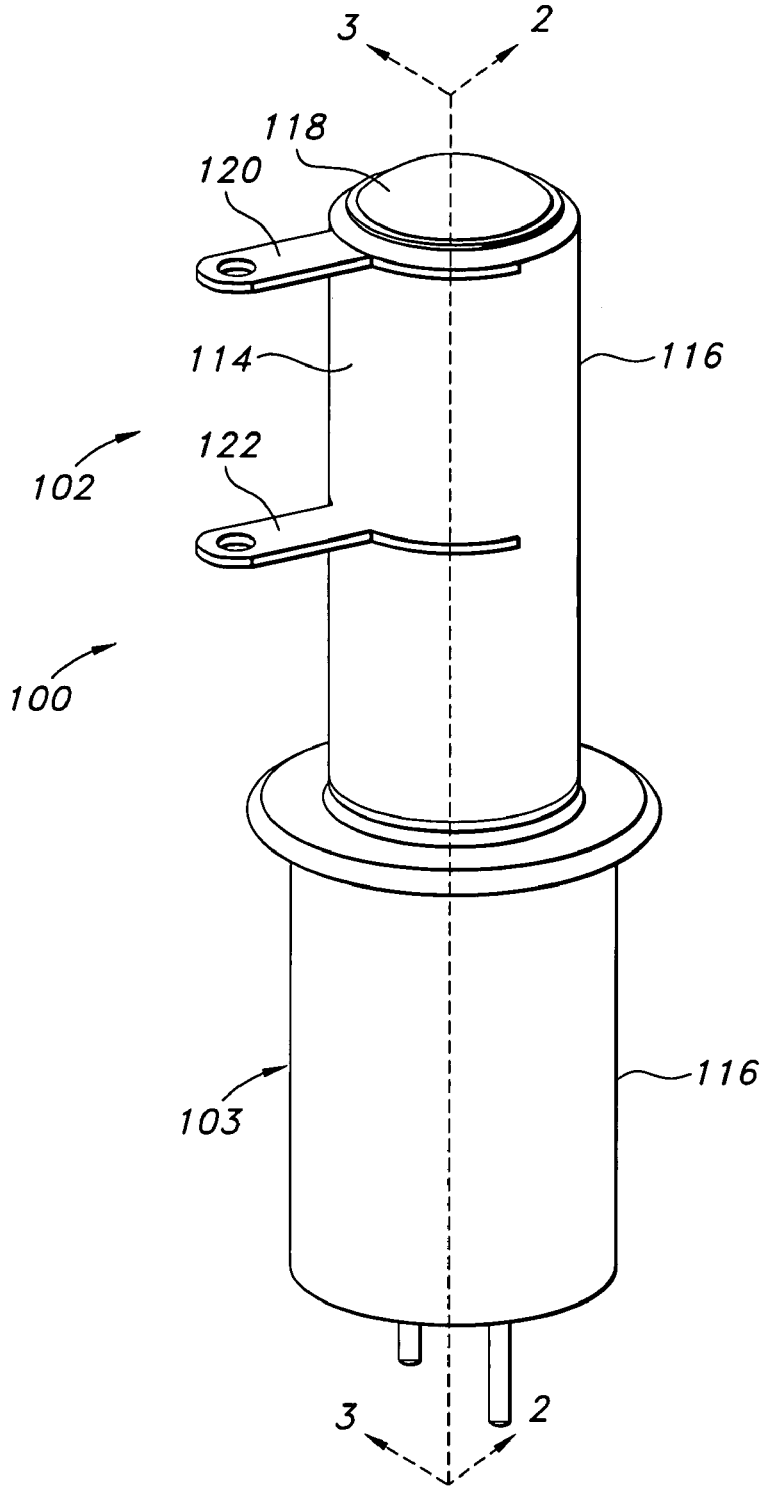
FIG. 1 is a perspective view illustrating an electrical switching device having a pivoting actuator assembly according to an embodiment of the invention.
Figure 2:
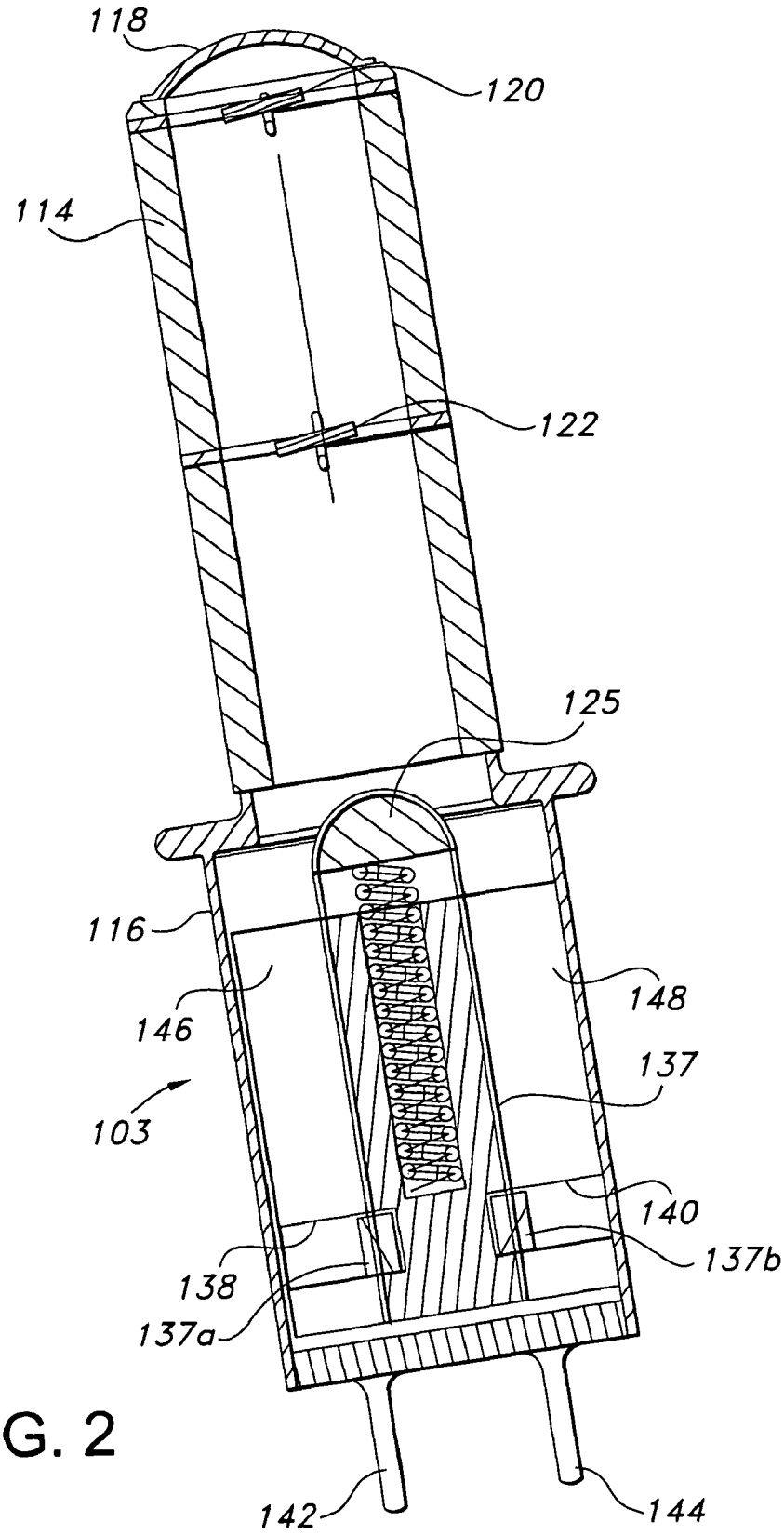
FIG. 2 is a sectional view taken along line 2-2 in FIG. 1.
Figure 3:
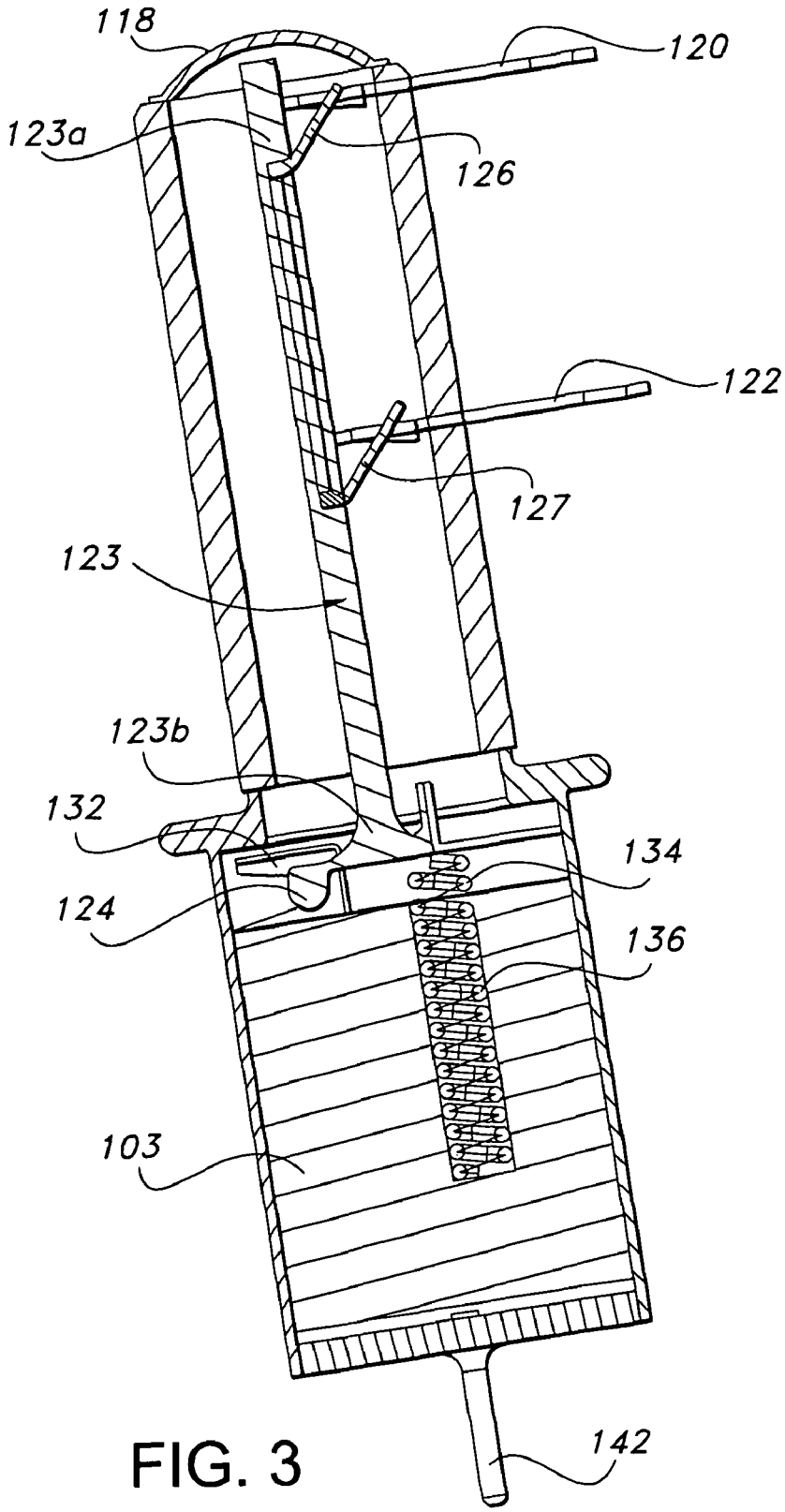
FIG. 3 is a sectional view taken along line 3-3 in FIG. 1.
Figure 4:
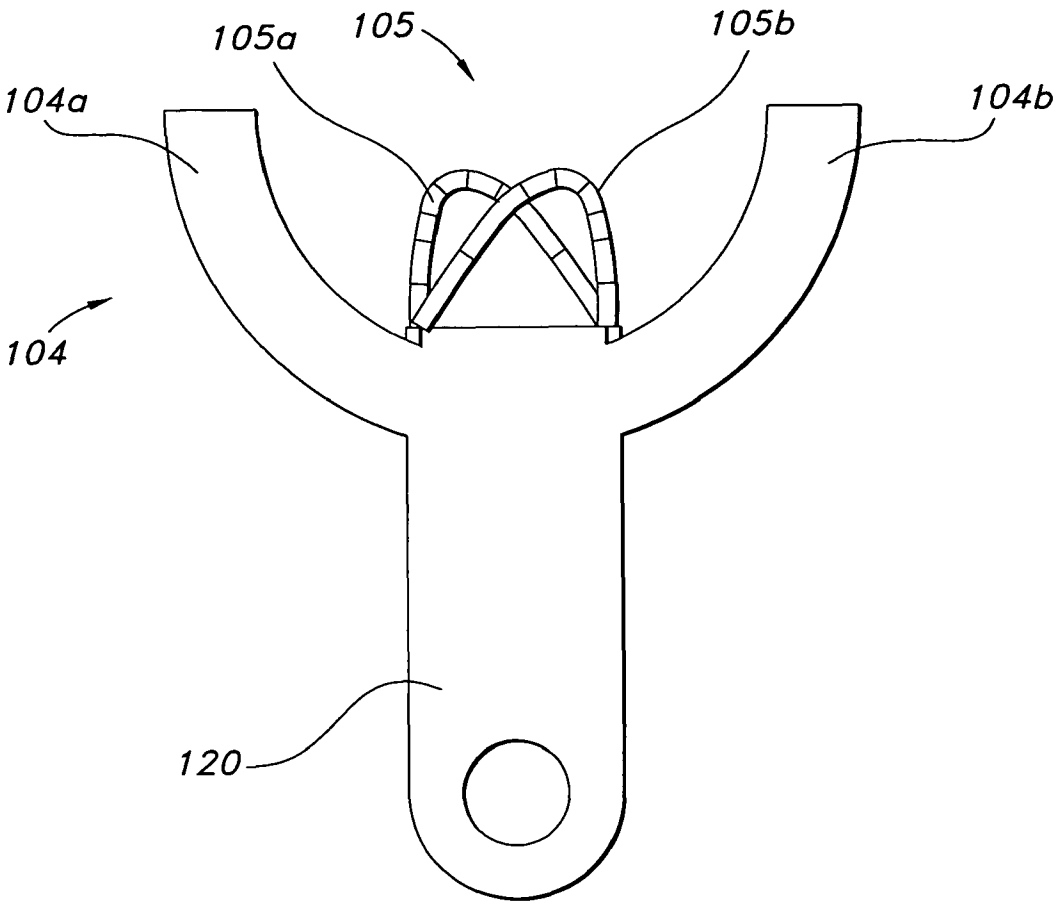
FIG. 4 is a top plan view of a contacting portion of the electrical switching device shown in FIG. 1.

Reference will now be made in detail to the presently preferred embodiments of the invention, examples of which are illustrated in the accompanying drawings. It is to be appreciated that corresponding reference numbers refer to generally corresponding structures.

FIGS. 1-11 illustrate exemplary electrical switching devices, which employ actuator mechanisms formed of a shape memory alloy (SMA) in accordance with exemplary embodiments of the present invention. Each electrical switching device 100 illustrated comprises a vacuum tube housing 102 connected to a base 103. The housing has one or more non-actuated electrical contacts 104 & 106 mounted therein. An actuator assembly 108 is supported within the housing 102 and base 103. The actuator assembly 108 includes a movable contact structure for engaging the non-actuated electrical contacts 104 & 106 to complete a circuit between the contacts 104 & 106 so that electrical current may flow between the contacts 104 & 106. The actuator assembly 108 moves the movable contact structure between an actuated position, wherein the movable contact structure engages the non-actuated electrical contacts 104 & 106 and a non-actuated position, wherein the movable contact structure is disengaged from the contacts 104 & 106. In exemplary embodiments, the non-actuated contacts 104 & 106 and the movable contact structure are formed of a conductive material such as copper, rhodium, a tungsten/molybdenum alloy, or the like.

The actuator assembly 108 further includes a shape metal alloy (SMA) element housed substantially within base 103 and formed of a shape metal alloy which changes shape upon the application of an electric current (e.g., when heated by the application of an electric current). In this manner, the application of an electrical current to the SMA element causes the SMA element to move the movable contact structure to either engage or disengage the non-actuated electrical contacts 104 & 106 so that the flow of an electric current through the contacts 104 & 106 is either allowed or inhibited. In exemplary embodiments, the SMA element is formed of a nickel-titanium alloy such as Nitinol. However, it is contemplated that the particular shape memory alloy (SMA) used will depend on a variety of factors, such as the specific application in which the electrical switching device 100 is to be used, the desired. Thus, it is contemplated that other shape memory alloys may be used. Such shape memory alloys may include, but are not necessarily limited to, copper-aluminum-nickel alloys, copper-zinc-aluminum alloys, iron-manganese-silicon alloys, and the like. These shape memory alloys (SMA) may be used in place of nickel-titanium alloys in specific applications of the invention without departing from the scope and intent of the present invention. In exemplary embodiments, the actuator may employ a shape memory alloy (SMA) exhibiting a one-way shape memory effect. In such embodiments, the SMA element, upon being heated by the application of an electric current, acquires a predetermined shape, geometry or length without the application of an external force. A return mechanism may be provided to return the actuator to its original position and condition prior to heating. In exemplary embodiments, the return mechanism may be mechanical (such as a spring), hydraulic, pneumatic, or the like. Alternatively, in other embodiments, the SMA element may employ a shape memory alloy (SMA) exhibiting a two-way shape memory effect, wherein the SMA element acquires two different shapes: one a low temperature shape when no electrical current is applied, and the other a high temperature shape acquired upon application of an electrical current. Additionally, it is contemplated that the specific metallurgical content of the shape memory alloys (SMA) employed may be varied to provide the electrical switching device 100 with specific performance characteristics (e.g., response time, contact force, fatigue life, or the like).

FIGS. 1-6 illustrate a vacuum relay electrical switching device 100 having a pivoting actuator assembly 108 according to an embodiment of the invention. As shown in FIG. 1, the electrical switching device 100 includes a vacuum tube housing 102 comprising a tubular insulator 114 formed of an electrically insulating material such as glass, a ceramic, a sufficiently electrically insulating thermoset or thermoplastic, or the like. Depending on the composition of the tubular insulator, an outer case 116 may be provided to surround and protect the tubular insulator. A cap 118 is coupled to the insulator 114 via a braze joint, crimp joint, or the like. In high-voltage RF applications and the like, the volume within the vacuum tube housing 102 (e.g., within the cylindrical volume of the insulator 114) is at least partially evacuated to form a vacuum which functions as a dielectric. Alternatively, the volume within the vacuum tube housing 102 may be filled with a gas such as sulfur hexafluoride (SF6), air, or the like. In the embodiment illustrated, a first non-actuated contact 104 is supported in the insulator 114 of the housing 102 near the middle of the insulator 114. Similarly, a second non-actuated contact 106 is provided adjacent the cap 118 of the insulator 114. Tabs 120, 122 couple the non-actuated contacts 104, 106 to external circuits (not shown). First non-actuated contact 104 is shown in detail in FIG. 4, and includes first and second arms 104*a*, 104*b* each of which having a curvature substantially similar to the curvature of vacuum tube housing 102. The first non-actuated contact also has a contacting portion 105 that comprises first and second intersecting portions 105*a*, 105*b*. The first and second intersecting portions are movable when force is placed thereupon. Second non-actuated electrical contact 106 is constructed similarly to first non-actuated electrical contact 104.

Figure 5:
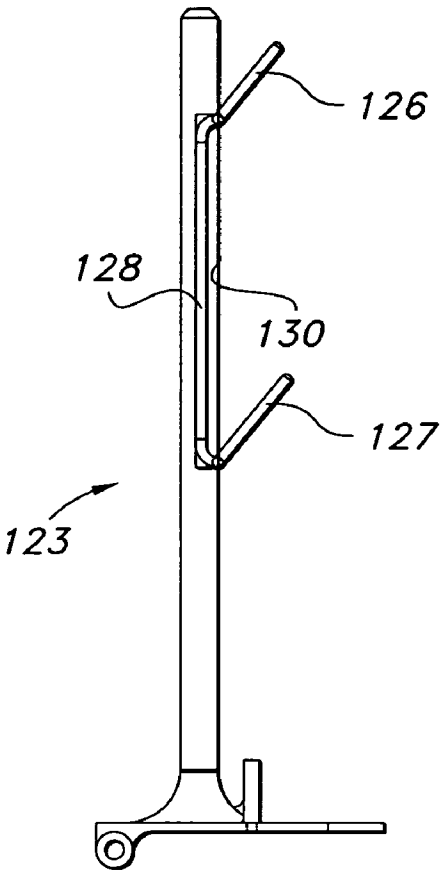
FIG. 5 is a side elevational view of a non-conductive shaft used in the electrical switching device of FIG. 1.

The actuator assembly includes a non-conductive shaft 123 (FIG. 3) having a length somewhat longer than the length of insulator 114. The first end 123*a* of shaft 123 is disposed adjacent cap 118. As shown in more detail in FIGS. 5 and 6, the second end 123*b* of the shaft includes a pivot axle 124 and a semi-circular saddle 125 disposed thereon. Shaft 123 has first and second shaft contacts 126, 127 that extend from the shaft. The shaft contacts are electrically conductive and, as shown in FIG. 5, are electrically connected to each other through a conductive wire 128 that passes through a hollow portion 130 of shaft 123. When assembled, first shaft contact 126 is positioned to be adjacent first non-actuated electrical contact 104, and second shaft contact 127 is positioned to be adjacent second non-actuated electrical contact 106.

Figure 6:
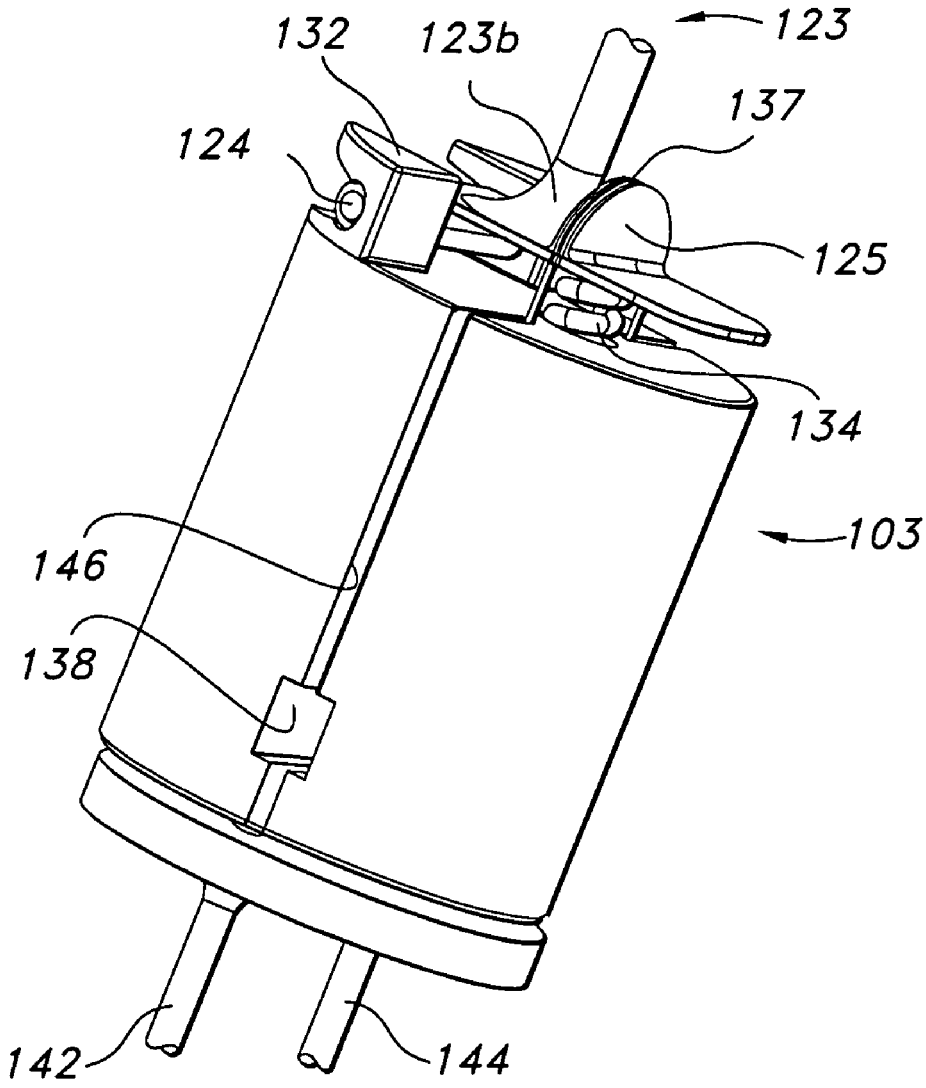
FIG. 6 is a perspective view of various internal components of the electrical switching device of FIG. 1.

Base 103 is depicted in detail in FIG. 6. Base 103 is preferably made of a thermoset material and is molded and/or machined to define its structure as described herein. Base 103 includes an axle support structure 132 into which pivot axle 124 is installed. Axle support structure 132 prevents pivot axle 124 from all movement except for rotation about axis A. A spring 134 is disposed in a spring recess 136 formed in base 103. Spring 134 is formed generally parallel to non-conductive shaft. In the present embodiment, the SMA element is a wire 137 formed of a shape memory alloy disposed substantially within base 103. The first and second ends 137*a*, 137*b* of wire 137 are crimped with a conductive material and are housed in first and second crimp recesses 138, 140 that are formed in base 103. Wire 137 is selected to have a length sufficient to wind around saddle 125 of non-conductive shaft 123. The diameter of wire 137 may be selected according to required performance requirements. For a relay switch used in an antenna coupler a wire diameter of 0.02 inches has been found to have sufficient strength to actuate switching device 100. First and second crimped ends 137*a*, 137*b* of wire 137 are electrically coupled to first and second pins 142, 144, respectively, which are mounted to the bottom of base 103 and extend from the outer surface of the bottom of the base so that a first electric current may be applied to the wire.

The presently disclosed embodiment is assembled by first placing spring 134 into spring recess 136. Pivot axle 124 of non-conductive shaft 123 is placed into axle support structure 132 of base 103. The first crimped end 137*a* of wire 137 is placed into first crimp recess 138. Wire 137 is threaded through a first wire groove 146 that is formed in base 103. Non-conductive shaft 123 is rotated so that second end 123*b* presses down against spring 134. Wire 137 is placed upon saddle 125, which is preferably grooved along its perimeter so that the wire is maintained thereon. The wire is then threaded through a second wire groove 148 that is formed in base 103, and second crimped end 137*b* of the wire is placed into second crimp recess 140. Non-conductive shaft 123 is then released, permitting spring 134 to push against second end 123*b* of the shaft, which rotates the shaft until wire 137 is taut. First and second shaft contacts 126, 127 will be adjacent to, but will not touch, contacting portions 105 of first and second non-actuating electrical contacts 104, 106, respectively. Base 103 is crimped or otherwise sealed to tubular insulator 114, and the internal volume of the tubular insulator may be evacuated as previously discussed.

In operation, a first electric current is applied to wire 137 through first and second pins 142, 144. The wire contracts and shortens, urging saddle 125 against spring 134 and pivoting non-conductive shaft 123 downward at pivot axle 124. The non-conductive shaft 123 moves toward first and second non-actuated electrical contacts 104, 106, such that first and second shaft contacts 126, 127 engage and move along the surfaces of the contacting portions 105 of the respective first and second non-actuated electrical contacts. A circuit is thereby completed between first and second non-actuated electrical contacts 104, 106 so that a second electric current may flow therebetween. The movement of the shaft contacts along the contacting portions 105 acts as a 'brushing' electrical contact that helps prevent oxidation that readily occurs on high-voltage HF electrical contacts.

When the first electric current is removed from wire 137, contraction of the wire ceases and the wire is allowed to expand as urged by spring 134. The spring, being no longer compressed by the wire, extends and pivots the non-conductive shaft 123 upward, which pivots the first and second shaft contacts 126, 127 away from the first and second non-actuated electrical contacts, respectively, until there is no engagement therebetween. The circuit between the first and second non-actuated electrical contacts is opened, and flow of the second electric current therebetween is inhibited. It is contemplated that, in exemplary embodiments, the diameter (gauge) of wire 137 and the shape memory alloy (SMA) material from which the wire is fabricated may be selected to achieve the relay performance attributes required by the application in which the vacuum relay electrical switching device 100 is used.

Figure 7:
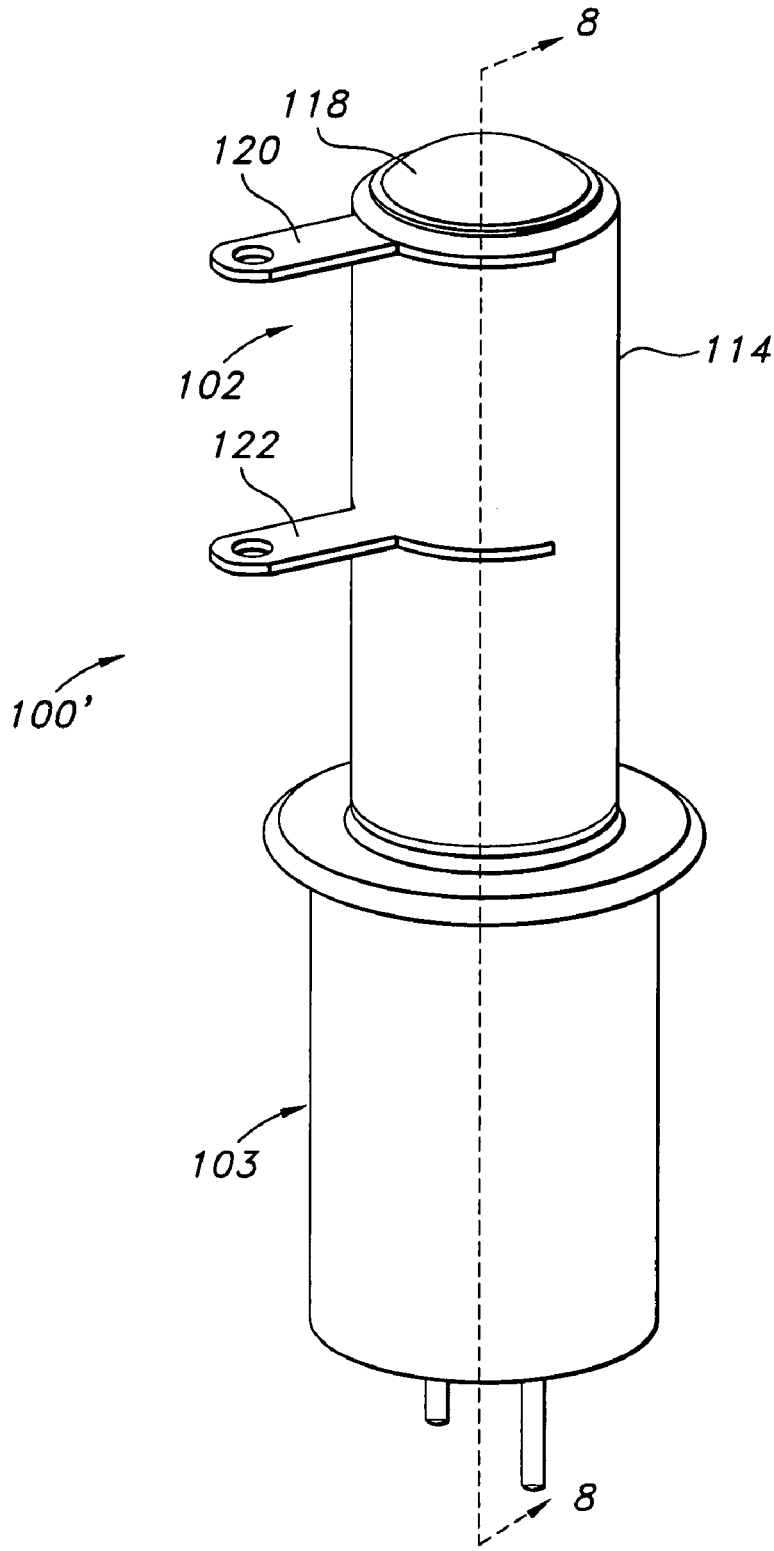
FIG. 7 is a perspective view illustrating an electrical switching device having a pivoting actuator assembly according to another embodiment of the invention.

FIGS. 7-11 illustrate a second vacuum relay electrical switching device 100' having a rotating actuator assembly 108' in accordance with an exemplary embodiment of the present invention. In this embodiment, the electrical switching device 100' again includes a vacuum tube housing 102 attached or connected to a base 103 (FIG. 7). Housing 102 comprises a tubular insulator 114 and an optional outer case, which is not depicted in this embodiment. Tubular insulator 114 is formed of an electrically insulating material such as glass, a ceramic, a sufficiently insulating thermoset or thermoplastic, or the like. A cap 118 is coupled to the insulator 114. In high-voltage RF applications and the like, the volume within the vacuum tube housing 102 (e.g., within cylindrical volume of the insulator 114) may be at least partially evacuated to form a vacuum which functions as a dielectric. Alternatively, the volume within the vacuum tube housing may be filled with a gas such as sulfur hexafluoride (SF6), air, or the like. A first non-actuated electrical contact 104' is provided adjacent the cap 118 of the insulator 114, while a second non-actuated electrical contact 106' is supported in the insulator 114 near the middle of the insulator 114. Tabs 120, 122 couple the non-actuated electrical contacts 104, 106, to external circuits (not shown). First non-actuated contact 104' is shown in detail in FIG. 9, and includes first and second arms 104'*a*, 104'*b*, each of which having a curvature substantially similar to the curvature of vacuum tube housing 102. The first non-actuated contact also has a contacting portion 105' that comprises an insert 105'*a* having a surface of gradually reduced curvature when compared to the curvature of the first and second arms 104'*a*, 104'*b*. Insert 105'*a* is designed to be flexible or movable when force is placed thereupon. Second non-actuated electrical contact 106' is constructed similarly to first non-actuated electrical contact 104'.

Figure 8:
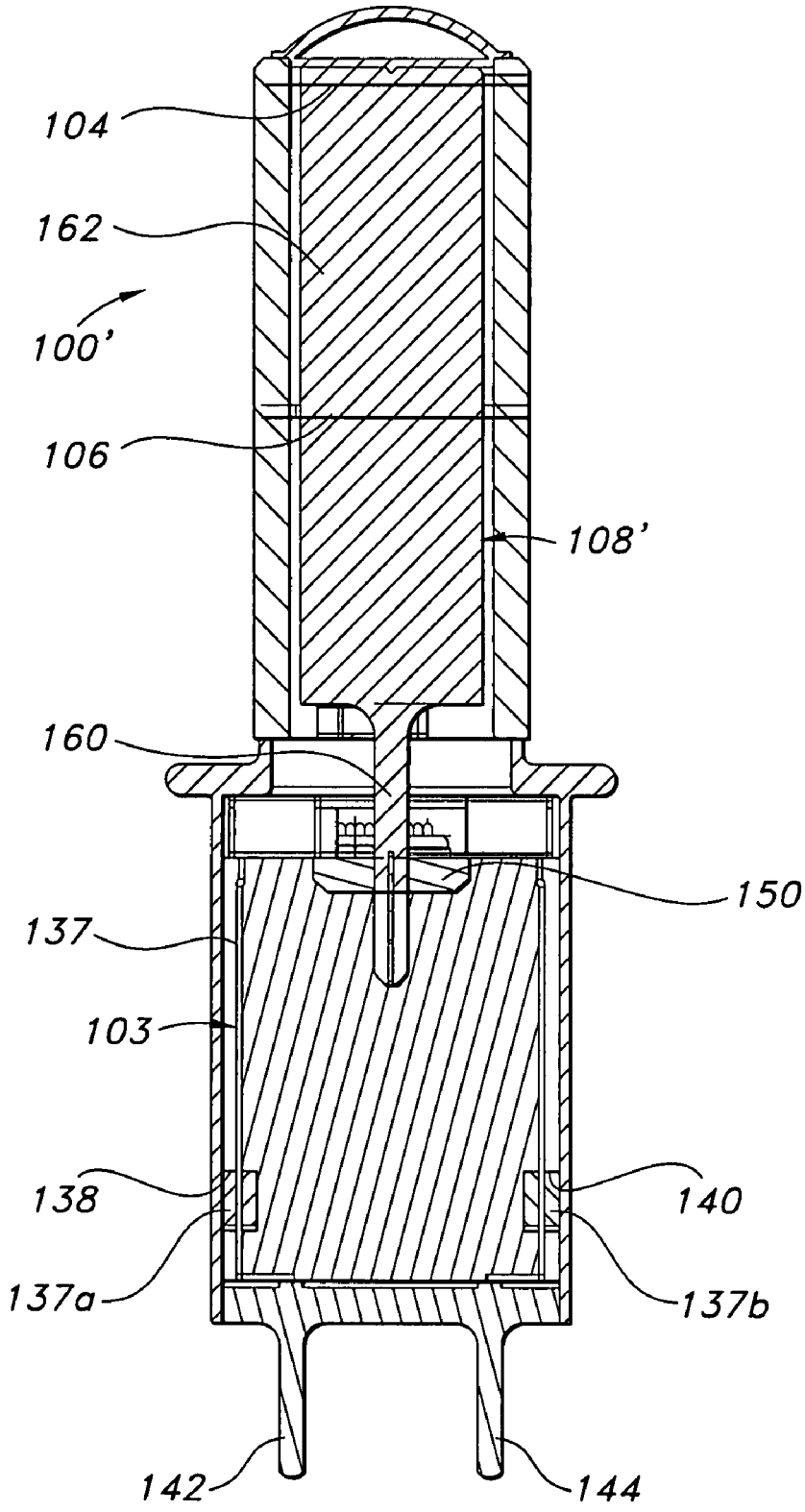
FIG. 8 is a sectional view taken along line 8-8 in FIG. 7.
Figure 9:
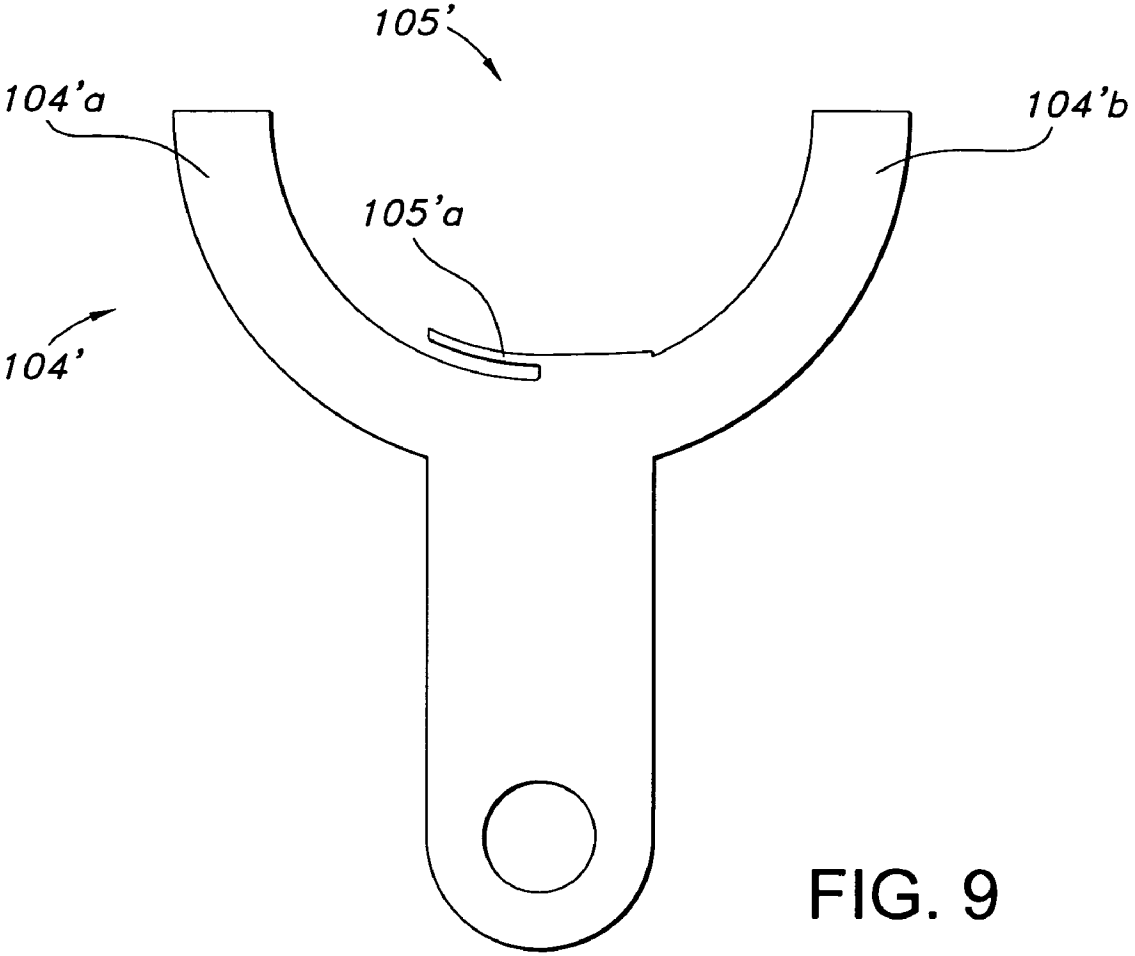
FIG. 9 is a top plan view of a contacting portion of the electrical switching device shown in FIG. 7.
Figure 10:
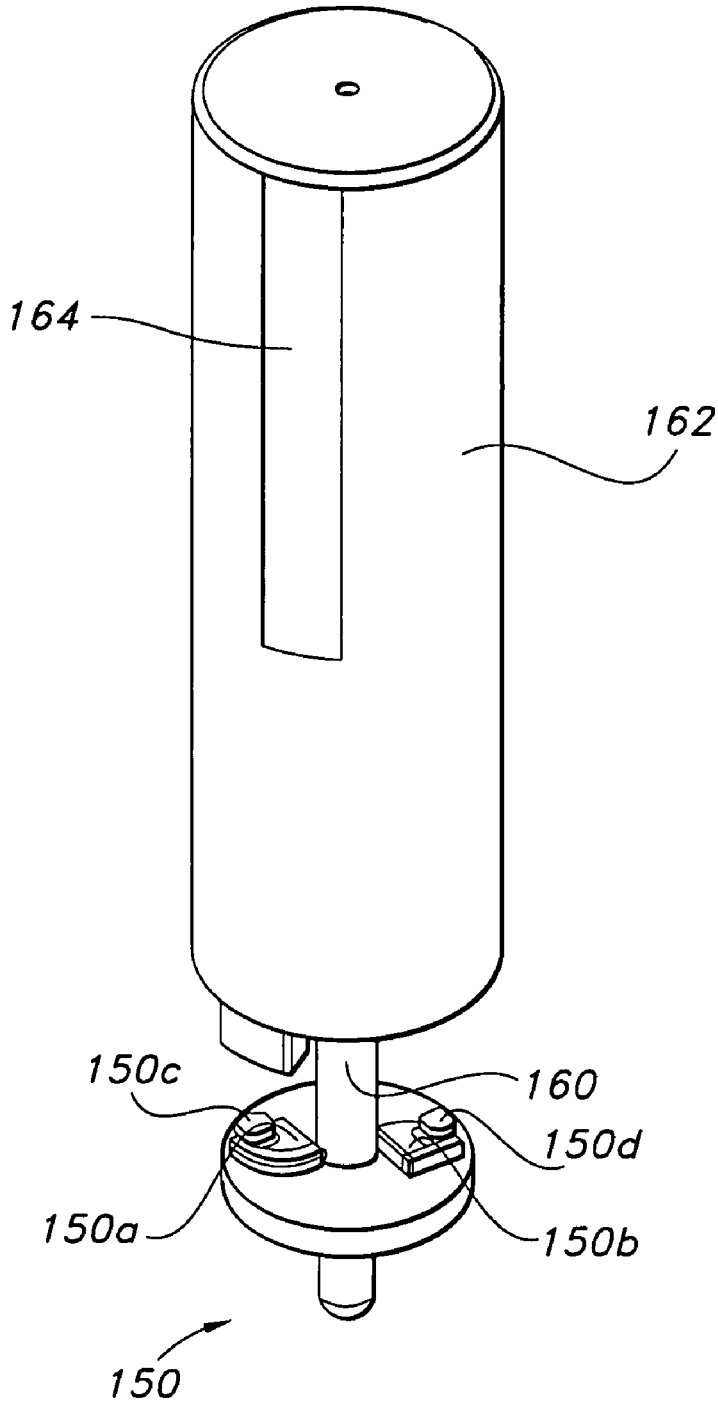
FIG. 10 is a perspective view of various internal components of the electrical switching device of FIG. 7.
Figure 11:
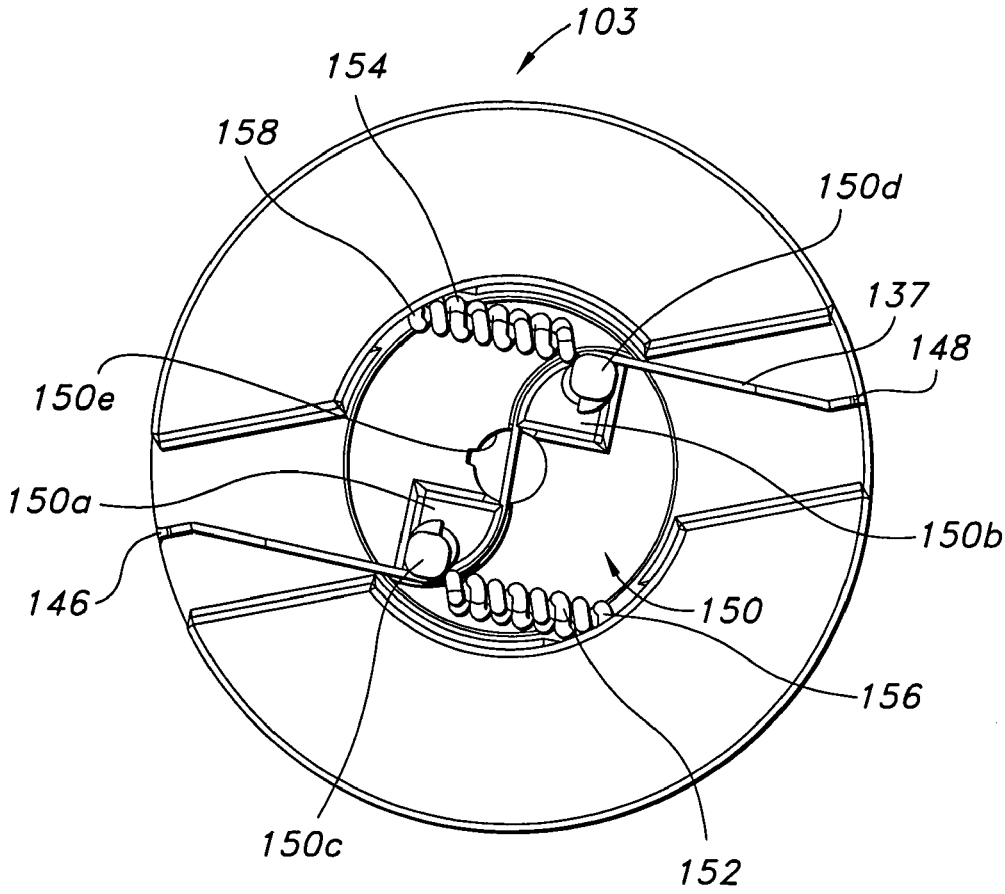
FIG. 11 is a top plan view of various internal components of the electrical switching device of FIG. 7.

In this embodiment, the actuator assembly includes a wire 137, made of an SMA material, and attached to base 103. The wire 137 is electrically coupled to first and second pins 142, 144 that are mounted to the bottom of base 103 and extend from the outer surface of the bottom of the base. The wire is threaded around two grooved extensions 150*a*, 150*b* formed on a spindle 150 (FIG. 11). The spindle is mounted in or upon the base and rotatable with respect thereto. First and second springs 152, 154 are attached to spring mounting bosses 156, 158 on base 103 and on bosses 150*c*, 150*d* of spindle 150. Bosses 150*c*, 150*d* are shown as being part of grooved extensions 150*a*, 150*b*, respectively. As shown in FIGS. 8 and 10, a keyed non-conductive shaft 160 is inserted into a correspondingly keyed opening 150*e* of the spindle such that the spindle and shaft rotate together. Keyed shaft 160 is attached to a hollow cylindrical drum 162. The drum 162 has a conductive strip 164 applied thereon. Conductive strip 164 has a length equal or greater to the distance between the first and second non-actuated electrical contacts. The drum substantially fills the cylindrical volume of insulator 114, although the drum is designed to rotate even when conductive strip 164 contacts first and second non-actuated electrical contacts 104', 106'.

To assemble the embodiment shown in FIGS. 7-11, spindle 150 is placed into or upon base such that the spindle is free to rotate. First and second springs 152, 154 are attached to spring mounting bosses 156, 158 on base 103 and on bosses 150*c*, 150*d* of spindle 150. The first crimped end 137*a* of wire 137 is placed into a first crimp recess 138. Wire 137 is threaded through a first wire groove 146 that is formed in base 103, as well as around grooved extensions 150*a*, 150*b* of the spindle. The spindle is rotated against the force of the first and second springs. Wire 137 is then threaded through a second wire groove 148 that is formed in base 103, and second crimped end 137*b* of the wire is placed into second crimp recess 140. The spindle is then released, permitting first and second springs 152, 154 urge spindle to rotate until wire 137 is taut. Non-conductive shaft 160 is placed into keyed opening 150*e*. Tubular insulator 114 is placed over drum 162, which is attached to the non-conductive shaft, such that conductive strip 164 does not contact first and second non-actuating electrical contacts 104', 106'. Base 103 is crimped or otherwise sealed to tubular insulator 114, and the internal volume of the tubular insulator may be evacuated as previously discussed.

In operation, a first electric current is applied to wire 137 through first and second pins 142, 144. The wire contracts and shortens, which urges the grooved extensions 150*a*, 150*b* toward each other, thereby causing rotation of spindle 150 and the non-conductive shaft 160 keyed thereto. Rotation of non-conductive shaft 160 causes drum 162 to rotate toward first and second non-actuated electrical contacts 104', 106', such that conductive strip 164 engage and move along the contacting surfaces of the first and second non-actuated electrical contacts. A circuit is thereby completed between first and second non-actuated electrical contacts 104', 106' so that a second electric current may flow therebetween. The movement of the conductive strip along the contacting surfaces of the first and second non-actuated electrical contacts acts as a 'brushing' electrical contact that helps prevent oxidation that readily occurs on high-voltage HF electrical contacts.

When the first electric current is removed from wire 137, contraction of the wire ceases and the wire is allowed to expand as urged by first and second springs 152, 154. The first and second springs, being no longer expanded by the contracting force of the wire, contract and rotate the spindle 150 and non-conductive shaft 160, which also rotates conductive strip 164 away from the first and second non-actuated electrical contacts until there is no engagement therebetween. The circuit between the first and second non-actuated electrical contacts is opened, and flow of the second electric current therebetween is inhibited. It is contemplated that, in exemplary embodiments, the diameter (gauge) of wire 137 and the shape memory alloy (SMA) material from which the wire is fabricated may be selected to achieve the relay performance attributes required by the application in which the vacuum relay electrical switching device 100' is used.

The invention may be varied in many ways while maintaining the spirit of the invention. For example, in the first disclosed embodiment, wire 137 is discussed as being wrapped once around saddle 125, and in the second embodiment the wire is threaded once around grooved extensions 150*a*, 150*b* on spindle 150. However, if further actuating force is required, the wire may be wrapped a plurality of times around the saddle or the extensions. Alternatively, to gain more actuating force the composition, size, and/or shape of the wire may be varied. As another example of variation, the disclosed coil springs 134, 152, 154 function to dampen vibrations as well as urge wire 137 to expand to its original length when electric current ceases to flow therethrough. The coil springs may therefore be replaced by other types of springs, such as a torsion spring, or by other types of mechanisms that provide satisfactory dampening and expanding reactions, such as a plug or element made of rubber, rubberized material, foam, or the like.

The embodiments described herein have shown how an SMA wire, when actuated, moves a movable contact between a non-actuated position and an actuated position. However, the scope of the invention is broad enough to encompass the use of an SMA wire to move, when actuated, a movable contact between an actuated position and a non-actuated position. Such a variation would open an electric circuit between the non-actuated electrical contacts instead of closing an electric circuit as has been described herein.

The invention has been described as a relay switch relying upon the contracting and expanding characteristics of an SMA wire. An advantage of the invention is that the relay switch's reliability increases when compared to traditional solenoid-based switches. From a mechanical point of view, a relay switch using an SMA wire to actuate a switch is more reliable than a solenoid using magnetism to actuate the same switch. With an SMA wire, the mechanics of the relay are stable.

Another advantage is that with the solenoid replaced by the SMA wire, the relay switch design becomes less complicated, thereby reducing manufacturing costs.

Another advantage is that, when compared to a solenoid-based design, the cost of raw materials of the invention are not highly dependent on wildly fluctuating prices of commodities such as copper. Price stability is therefore much easier to achieve.

Still another advantage is that with the simple design and the elimination of the copper-based solenoid, manufacturing yields substantially increase.

Yet another advantage is that assembly of the embodiments of the invention is simple enough to be done on an assembly line.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. An electrical switching device, comprising:

a housing having first and second non-actuated electrical contacts;

a base, connected to the housing, having electrical leads configured to receive a first electric current;

an actuator assembly supported within the housing and the base, the actuator assembly including a rotatable, substantially non-conductive shaft;

a movable contact structure mounted upon the shaft and configured to be activated by the first electric current between a non-actuated position, where the movable contact structure does not provide a conductive path between the first and second non-actuated electrical contacts, and an actuated position, where the movable contact structure provides a conductive path between the first and second non-actuated electrical contacts so that a second electric current may flow therebetween;

the actuator assembly further including a rotatable spindle mounted upon the base and configured to rotate with the shaft;

the actuator assembly also including a wire element made from a shape memory alloy (SMA), the wire element anchored to the base and threaded upon the spindle, the wire element having a length that is reduced when the first electric current is applied thereto to thereby rotate the spindle, shaft, and the moveable contact structure between one of the non-actuated position and the actuated position and the other of the non-actuate position and the actuated position, wherein the moveable contact structure comprises:

a cylindrical drum mounted inside the housing and configured to rotate with the shaft; and a conductive strip applied to an outer surface of the cylindrical drum, and having a length at least as long as a distance between the first and second non-actuated electrical contacts.

2. The electrical switching device of claim 1, wherein each of the first and second non-actuated electrical contacts includes a contacting portion extending toward the respective shaft contact, wherein the conductive strip movingly contacts the contacting portion of each of the first and second non-actuated electrical contacts when the actuator assembly moves between the actuated position and the non-actuated position.

3. An electrical switching device, comprising:

a housing having first and second non-actuated electrical contacts;

abuse connected to the housing, having electrical leads configured to receive a first electric current;

an actuator assembly supported within the housing and the base, the actuator assembly including a rotatable, substantially non-conductive shaft;

a movable contact structure mounted upon the shaft and configured to be activated by the first electric current between a non-actuated position, where the movable contact structure does not provide a conductive path between the first and second non-actuated electrical contacts, and an actuated position, where the movable contact structure provides a conductive path between the first and second non-actuated electrical contacts so that a second electric current may flow therebetween;

wherein the moveable contact structure includes a cylindrical drum mounted inside the housing and configured to rotate with the shaft, and a conductive strip applied to an outer surface of the cylindrical drum, the conductive strip having a length at least as long as a distance between the first and second non-actuated electrical contacts; and the actuator assembly further including a rotatable spindle mounted upon the base and configured to rotate with the shaft;

a wire element made from a shape memory alloy (SMA), the wire element anchored to the base and threaded around the spindle, the wire element having a length that is reduced when the first electric current is applied thereto to thereby rotate the spindle, shaft, and the moveable contact structure between one of the non-actuated position and the actuated position and the other of the non-actuated position and the actuated position; and a return mechanism configured to urge the wire to increase in length when the first electric current is no longer applied thereto.

4. The electrical switching device of claim 3, wherein the wire element is made of one of a copper-zinc-aluminum alloy, a copper-aluminum-nickel alloy, and an iron-manganese-silicon alloy.

5. The electrical switching device of claim 3, wherein each of the first and second non-actuated electrical contacts includes a contacting portion extending toward the respective shaft contact, wherein the conductive strip movingly contacts the contacting portion of each of the first and second non-actuated electrical contacts when the actuator assembly moves between the actuated position and the non-actuated position.

* * * * *